United States Patent [19]

Evancho et al.

[11] 4,082,578

[45] Apr. 4, 1978

[54] ALUMINUM STRUCTURAL MEMBERS FOR VEHICLES

[75] Inventors: Joseph W. Evancho, Pittsburgh; Barrie S. Shabel, Murrysville; William G. Truckner, Avonmore, all of Pa.

[73] Assignee: Aluminum Company of America, Pittsburgh, Pa.

[21] Appl. No.: 711,954

[22] Filed: Aug. 5, 1976

[51] Int. Cl.[2] ..... C22F 1/04

[52] U.S. Cl. ..... 148/12.7 A

[58] Field of Search ..... 148/11.5 A, 12.7 A

[56] References Cited

U.S. PATENT DOCUMENTS

| | | | |
|---|---|---|---|
| 3,212,941 | 10/1965 | O'Brien | 148/12.7 A |
| 3,454,435 | 7/1969 | Jacobs | 148/12.7 A |
| 3,617,395 | 11/1971 | Ford | 148/12.7 A |
| 3,935,007 | 1/1976 | Baba et al. | 148/12.7 A |
| 3,944,439 | 3/1976 | Pryor et al. | 148/11.5 A |
| 4,000,007 | 12/1976 | Develay et al. | 148/12.7 A |
| 4,010,046 | 3/1977 | Setzer et al. | 148/12.7 A |

*Primary Examiner*—W. Stallard

*Attorney, Agent, or Firm*—Andrew Alexander; Carl R. Lippert

[57] ABSTRACT

Aluminum alloy products particularly for use in automotive applications may be advantageously produced from a body of aluminum base alloy consisting essentially of, by weight, 0.4 to 1.2% Si, 0.4 to 1.1% Mg, 0.2 to 0.8% Mn, 0.05 to 0.35% Fe, 0.1 to 0.6% Cu, the balance essentially aluminum and incidental elements and impurities. The alloy body may be homogenized at a temperature in the range of 900° to 1100° F and thereafter worked into wrought products such as sheet or extrusions which are solution heat treated and quenched and aged to a T4 condition prior to forming into automotive body panels, bumpers or the like, which may then be strengthened by heating or aging to the T6 condition.

54 Claims, 5 Drawing Figures

ALUMINUM STRUCTURAL MEMBERS FOR VEHICLES

INTRODUCTION

This invention relates to improved aluminous body panels, bumpers, wheels and other structural members for automobiles and other vehicles and to methods for providing the same.

Because of the increasing emphasis on producing lower weight automobiles in order, among other things, to conserve energy, considerable effort has been directed toward developing aluminum alloy products suited to automotive application. Especially desirable would be a single aluminum alloy product useful in several different automotive applications. Such would offer scrap reclamation advantages in addition to the obvious economies in simplifying metal inventories. Yet, it will be appreciated that different components on the automobile can require different properties in the form used. For example, an aluminum alloy sheet when formed into shaped outside body panels should be free of leuders' lines, whereas the presence or absence of such lines on inside support panels, normally not visible, is less important. Lueders' lines are lines or markings appearing on the otherwise smooth surface of metal strained beyond its elastic limit, usually as a result of a multi-directional forming operation, and reflective of metal movement during that operation. Bumper applications on the other hand require such properties as high strength, plus resistance to denting and to stress corrosion cracking and exfoliation corrosion, usually together with receptiveness to chrome plating. To serve in a wide number of automotive applications, an aluminum alloy product needs to possess good forming characteristics to facilitate shaping, bending and the like, without cracking, tearing, lueders' lines or excessive wrinkling or press loads, and yet be possessed of adequate strength. Since forming is typically carried out at room temperature, formability at room or low temperatures is often a principal concern. Still another aspect which is considered important in automotive uses is weldability, especially resistance spot weldability. For example, the outside body sheet and inside support sheet of a dual sheet structure such as a hood, door or trunk lid are often joined by spot welding and it is important that the life of the spot welding electrode is not unduly shortened by reason of the aluminum alloy sheet so as to cause unnecessary interruption of assembly line production, as for electrode replacement. Also, it is desirable that such joining does not require extra steps to remove surface oxide, for example. In addition, the alloy should have high bending capability without cracking or exhibiting orange peel, since often the structural products are fastened or joined to each other by hemming or seaming.

Various aluminum alloys and sheet products thereof have been considered for automotive applications, including both heat treatable and non-heat treatable alloys. Heat treatable alloys offer an advantage in that they can be produced at a given lower strength level in the solution treated and quenched temper which can be later increased by artificial aging after the panel is shaped. This offers easier forming at a lower strength level which is thereafter increased for the end use. Further, the thermal treatment to effect artificial aging can sometimes be achieved during a paint bake treatment, so that a separate step for the strengthening treatment is not required. Non-heat treatable alloys, on the other hand, are typically strengthened by strain hardening, as by cold rolling. These strain or work hardening effects are usually diminished during thermal exposures such as paint bake or cure cycles, which can partially anneal or relax the strain hardening effects.

One heat treatable alloy sheet product which has been considered is alloy 6151 (referring to the Aluminum Association registration number) whose registered composition range is, by weight, 0.6 to 1.2% silicon, 0.45 to 0.8% magnesium, 0.15 to 0.35% chromium, balance aluminum, with maximum limits on other elements as follows: 1.0% iron, 0.35% copper, 0.20% manganese and 0.25% zinc. However, using a sheet product of typical composition for alloy 6151 containing 0.85% silicon, 0.56% magnesium, 0.19% chromium, 0.48% iron, 0.19% copper, 0.20% zinc and 0.04% titanium, numerous problems were encountered, as forming attempts were hampered by cracking and the desired combinations of strength and formability were not realized.

Two other aluminum alloy sheet products have been given serious consideration for use in automotive applications, namely, alloys 2036 and 5182, and, in fact, both have seen limited use. Alloy 2036 is a heat treatable alloy containing 2.2 to 3.0% copper, 0.10 to 0.40% manganese, 0.30 to 0.60% magnesium and a maximum of 0.50% each for both silicon and iron as impurities, the remainder aluminum. It was used in the outer panel mainly because it had a yield strength of about 27 to 28 ksi which is comparable to that of steel, thus providing dent resistance similar to steel. Alloy 2036, however, is not possessed of sufficient workability to consistently form the more intricate shapes desired for some inner panel applications. Aluminum alloy 5182, a non-heat treatable alloy containing 4.0 to 5.0% magnesium, 0.20 to 0.50% manganese, balance aluminum with, as impurities, maxima of 0.20% silicon, 0.35% iron, 0.15% copper and 0.10% chromium and having a yield strength of about 17 ksi, was used for the inner support panel because of its high level of formability. However, it lacked sufficient strength and dent resistance to serve as the outer panel. Hence, the two alloy panel received considerable attention with the stronger and more dent resistant 2036 alloy serving as the outer panel and the more formable 5182 alloy serving as the inner panel. However, this particular two alloy system had several drawbacks. For example, during paint baking, the strength of the outer panel is only increased very slightly. Also, the baking can have an annealing effect on the inner support panel which for all practical purposes is a strain hardenable alloy. Thus, the baking can act to reduce the strength of the inner panel while only slightly increasing the strength of the outer panel, thereby sometimes weakening the overall dual panel structure.

Other disadvantages are inherent in any two alloy system. As indicated above, an important consideration is reclamation of the used aluminum component or the aluminum scrap generated in making such component. It should be noted that recovery or recyclability of such aluminum is an important aspect in the drive to conserve energy. However, to make recoverability of aluminum scrap economically attractive, the steps in such recovery operation should be kept as simple as possible. For instance, if various components are made from different alloys, for example 2036 and 5182, then in reclaiming such components they normally have to be separated in order to produce similar alloys. That is, from a scrap utilization standpoint, the copper in 2036 is considered not compatible with the composition of 5182. Also, the magnesium in 5182 is generally considered not compatible with the composition of 2036. As will be obvious, this separation can involve extra steps and thus can be economically obstructive to efficient scrap utilization. As well as having the various components compatible from a scrap reclamation point, another aspect which is important is the alloying constituents. It will be obvious to those skilled in the art that considerable tonnage of metal can be required for automobile production, and thus to provide this metal economically the alloying constituents should be those which have a low cost. This aspect, as well as others, work to keep the overall cost and weight of the automobile relatively low in addition to providing substantial fuel savings.

The present invention provides aluminum base alloy products and a method of processing such products into automotive components which overcome many of the problems of the prior art.

OBJECTS

A principal object of the present invention is to provide aluminum alloy wrought products, particularly for fabrication into selected automotive or vehicular components.

A further object of the present invention is to provide aluminum alloy wrought products having high forming capabilities yet having high strength on aging so as to enable its use in automotive or vehicular body applications.

These and other objects will become apparent from a reading of the specification and claims and an inspection of the drawings appended hereto.

SUMMARY OF THE INVENTION

In accordance with these objects, the present invention provides an aluminum alloy wrought product suitable for use in automotive applications, the alloy consisting essentially of, by weight, 0.4 to 1.2% Si, 0.4 to 1.1% Mg, 0.2 to 0.8% Mn, 0.05 to 0.35% Fe, 0.1 to 0.6% Cu, the balance essentially aluminum and incidental elements and impurities. In addition, the process of the invention preferably includes homogenizing the alloy at a temperature in the range of 900° to 1100° F for at least an hour, and thereafter working the body into wrought products which may be later fabricated into automobile components. The metal working operations can include rolling into sheet, which can be later formed into automobile panels, wheels, or bumpers. The working operations can also include extruding into members which may be formed into bumpers, for example. The working operations may be followed by solution heat treating and quenching to obtain sections suitable for the additional fabrication steps.

DETAILED DESCRIPTION OF THE PREFERRED EMBODIMENTS

Figure 1:
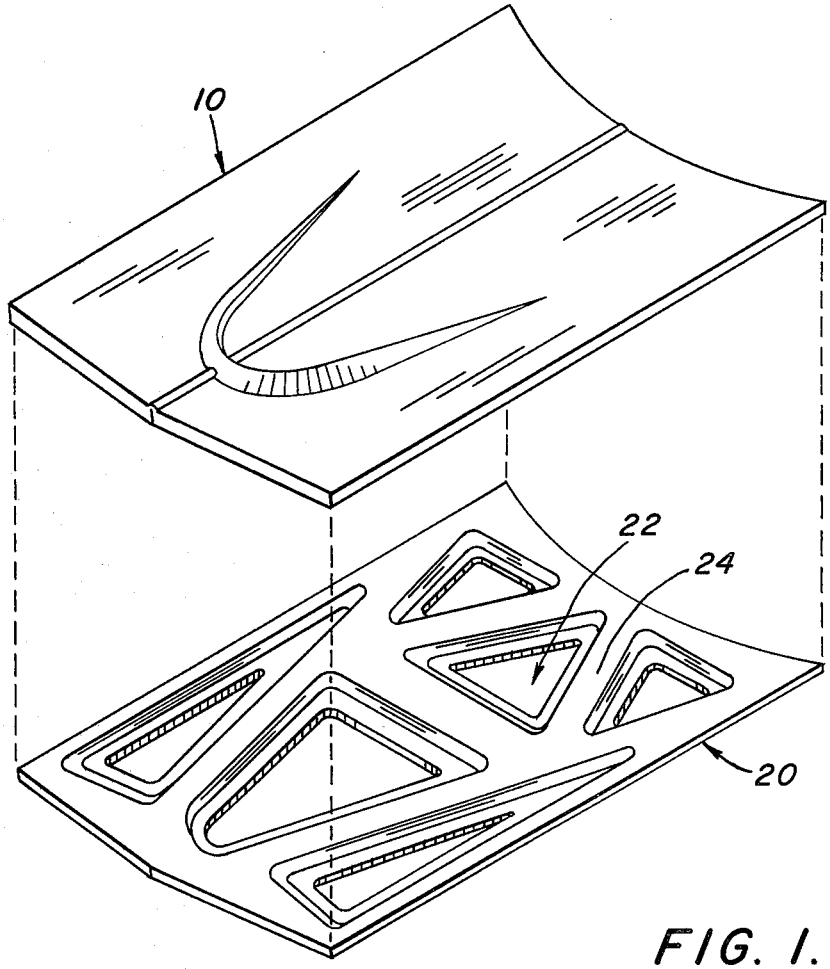
FIG. 1 is an exploded perspective view depicting a typical automotive hood and inner support panel.
Figure 2:
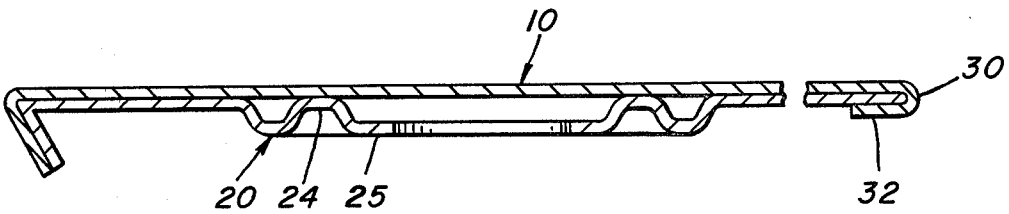
FIG. 2 is an elevational view in cross section of the hood and support panel assembly of FIG. 1.

Referring to FIG. 1, there is shown an exploded view of an automotive hood structure including outer panel 10 and inner panel 20 which are peripherally joined to provide the dual panel hood structure. Doors, trunk lids and other structures can employ similar construction. In FIGS. 1 and 2 it can be seen that outer panel 10 is of generally smooth configuration, while inner panel 20 is somewhat more complex or intricate and includes openings 22 and raised rib or channel-like portions 24 which serve to increase its flexural strength. Thus, as shown in FIG. 2, the inner panel 20 includes sheet portions 24 and 25 which lie in planes which are offset and in generally parallel relationship with each other, and this offsetting of these sheet portions provides added flexural strength to the inner panel 20 and, for that matter, to the entire hood assembly depicted in FIG. 2. The inner panel 20 is, as shown, shaped from a single sheet to provide its structural features, shaping being typically effected by stamping or pressing between opposite mating dies.

Figure 3:
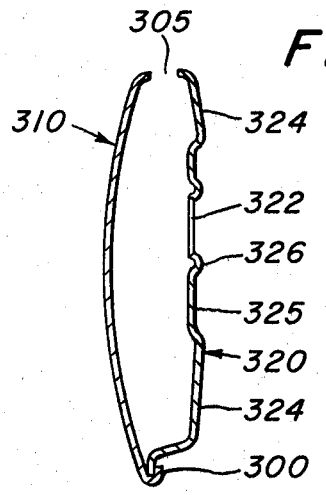
FIG. 3 is an elevation view in cross section of an automotive door structure.

Referring now to FIG. 3, there is depicted a cross-sectional view of an automotive door assembly 300 including outer panel 310 and inner panel 320. Referring to the inner panel 320, such typically includes one or more openings 322 therethrough together with outer sheet portions 324 and inner sheet portions 325 which are in offset generally parallel relationship with one another in similar manner as with panel 20 in FIG. 2. The metal around the opening 322 includes a portion 326 raised with respect to inner portion 325 and generally parallel thereto to provide stiffening around the opening 322. It thus can be further seen from FIGS. 1 through 3 that while the outer panel 10 or 310 is generally of a shape representative of an exterior portion of an automotive body and is of relatively simple generally arcuate configuration, the inner panel, 20 or 320, includes a number of offset portions provided by contouring the panel. Obviously, as to which portions are raised or recessed, such can depend on the side from which the panel is viewed and hence raised and recessed, or inner and outer, portion is intended to contemplate such arrangements irrespective of which side from which the panel is viewed when speaking broadly of the inner panel 20 standing alone. However, when describing a structure comprising inner and outer panels, raised outer portions refer to those such as 25 in FIG. 2 or 324 in FIG. 3 as seen facing the inner panel of the dual panel structure, that is, from the bottom in FIG. 2 or from the right in FIG. 3. Further, as is seen in FIG. 2, but more clearly in FIG. 3, there is a spaced generally parallel relationship between surfaces of the inner panel 320 and the outer panel 310. In fact, the respective inner and outer (or recessed and raised) surfaces of inner panel 320 lie in planes which are generally parallel but offset from each other and because the inner panel 320 is spaced from but generally parallel to the outer panel, the various surfaces of inner panel 320 are themselves spaced but generally parallel to the surface or surfaces of outer panel 310. However, in FIG. 2 it can be seen that recessed portion 24 is not substantially spaced from outer panel 10 whereas raised portion 25 is so spaced. This condition is not as common as where both raised and recessed portions of the inner panel are spaced from the outer panel.

Figure 4:
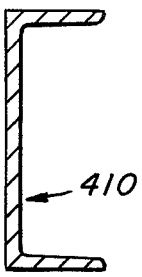
FIG. 4 is an elevation view in cross section of an extruded section.

In FIG. 4, there is depicted a cross section of a general channel-like member 410 suitable for use in automotive bumper applications. Typically, a length of such a section is curved through an arc which generally conforms with the shape across the front or rear of a vehicle.

Hence, in accordance with the invention, the term "formed panel" as referred to herein in its broadest sense is intended to include bumpers, doors, hoods, trunk lids, fenders, fender wells, floors, wheels and other portions of an automotive or vehicular body. Such a panel can be fashioned from a flat sheet which is stamped between mating dies to provide a three-dimensional contoured shape, often of a generally convex configuration with respect to the panels visible from the outside of a vehicle. The dual or plural panel members comprise two or more formed panels, an inside and an outside panel, the individual features of which are as described above, which inner and outer panels, as shown in FIGS. 2 and 3, can be peripherally joined or connected to provide the dual or plural panel assembly. In some arrangements, two panels do not sufficiently strengthen the structure which can be reinforced by a third panel extending along or across all or a portion of the length or width of the structure. While the structure includes a peripheral joint or connection between the inner and outer panels, such joint or connection extends around peripheral portions and need not encompass the entire periphery. For instance, referring to FIG. 3 which illustrates an automotive door panel, the peripheral joining can extend across the bottom, up both sides or ends and only but a short distance, if at all, from each end across the top. This allows for opening 305 for a retractable window assembly. While the dual panel structure depicted in FIGS. 1 through 3 show the inner and outer panels directly connected, which can be accomplished by welding, a seam joining or adhesive bonding, it is possible to connect the inner to outer panels via a third intermediary, or spacer, member not shown in the figures. Hence, the term "connected along peripheral portions of the inner and outer panels" is intended to encompass all such joining or connecting to provide a generally closed or coupled type structure as depicted in the figures. The dual or plural member structure can comprise one or more panels in the improved aluminum alloy wrought product although it is preferred that both panels be in the improved sheet product. On a less preferred basis, some embodiments contemplate in a structure comprising more than one panel, for instance two or more panels, one or more panels in the improved sheet product with the other panel, or panels, being formed from steel or perhaps another aluminum alloy.

The terms "automotive" or "vehicular" as used herein are intended to refer to automobiles, of course, but also to trucks, off-road vehicles, and other transport vehicles generally constructed in the general manner associated with automotive body or structural construction.

As noted earlier, the alloy of the present invention consists essentially of, by weight percent, 0.4 to 1.2% Si, 0.4 to 1.1% Mg, 0.2 to 0.8% Mn, 0.05 to 0.35% Fe, 0.10 to 0.6% Cu, the balance essentially aluminum and incidental impurities. The impurities are preferably controlled to provide not more than 0.2% Zn, and not more than 0.10% Ti with not more than 0.05% of each Zn and Ti being preferred. Other impurities are preferably limited to about 0.05% each and the combination of other impurities preferably should not exceed 0.15%. Within these limits it is preferred that the sum total of all impurities does not exceed 0.35%.

With respect to the main alloying constituents, it is preferred that silicon be in the range of 0.7 to 1.1% and magnesium be in the range of 0.4 to 0.9%. A further consideration is that it is preferred to have Si present between 0.2 and 0.5% excess, normally around 0.4% excess, over the stoichiometric equivalent of the Mg content based on the compound $Mg_2Si$. This preference is based on achieving a wide spread between the naturally aged forming temper and the artificially aged stronger temper. Within the herein set forth ranges for silicon and magnesium, further preferences can be applicable as set forth hereinbelow depending largely on the end product and the desired properties thereof.

As explained above, inner panel 20 derives its flexural strength largely from its shaped structural configuration. This, in turn, requires that the sheet from which the inner panel 20 is formed have a relatively high level of formability even if, at some expense in strength. With respect to outer panel 10, strength and dent resistance are favored even at some sacrifice in formability, which in the sense of intricacy is less critical. However, outer panel 10 is more sensitive to lueder's lines which have to be avoided. Thus, while in one aspect of formability outer panel 10 is less critical, it is more critical in another sense.

With respect to outer panel 10, and in the case of bumpers where high strength and dent resistance are preferred even at some sacrifice in formability which, nonetheless should facilitate forming without encountering lueders' lines, it is preferred to provide further controls for silicon and magnesium. For these type applications one preferred embodiment of the invention includes forming such members from the aluminum alloy described herein which contains silicon in the range of 0.9 to 1.1% and magnesium in the range of 0.7 to 0.9%. This provides an alloy, hereinafter referred to as alloy type I, which, after proper solution heat treatment and quenching as herein described and after aging into a T4 condition but before artificial aging, has a typical transverse yield strength for a sheet product in the range of 23 to 30 ksi which compares favorably with steel which typically has a yield strength of 26 to 27 ksi in these applications. After artificial aging, this alloy has a yield strength of over 50 ksi which is quite adequate in strength and dent resistance.

With respect to inner panel 20, strength for the sheet product is less critical since panel flexural strength is derived largely from its structural shape. However, it is important that such structure have sufficient strength when properly shaped. Inner panel 20 is less critical with respect to finish than outer panel 10 and, although panel 20 requires a higher degree of formability because of intricacy of shape, some surface defects can often be tolerated. For this type of application one preferred embodiment of the invention includes forming such structure from an aluminum alloy described herein which contains silicon in the range of 0.7 to 0.9% and magnesium in the range of 0.4 to 0.6%. This provides an alloy, hereinafter referred to as alloy type II, which, after proper solution heat treatment and quenching as herein described and after natural aging but before artificial aging, has a typical transverse yield strength for a sheet product in the range of 14 to 22 or 23 ksi and a high level of formability permitting the fabrication of intricately designed inner panel 20 without cracking of the metal. By artificial aging the yield strength of this alloy can be increased substantially.

It will be appreciated in practicing the invention that while it can be preferred to provide different composition limits with respect to the contemplated use of the component, for example, alloy types I and II respectively, for outer and inner panels, this difference in composition can be insufficient to interfere with the efficient recyclability of such alloys as noted earlier. That is, the compositions may be kept sufficiently similar to be reclaimed in the same system without the extra steps of classification.

It should be noted that it is desired to maximize the difference in strength levels between the fabricating temper and the final artificially aged temper of the present alloy system in order to allow for the formability requirements and yet maintain high strength in the end product. This can be achieved in part by controlling the silicon and magnesium content within the guidelines set forth above, especially when conforming guidelines discussed hereinbelow.

With respect to the amount of copper in the alloy used in accordance with the present invention, a preferred range is 0.25 to 0.50% Cu. This preferred range for copper applies to both ranges of silicon and magnesium referred to above. One important feature served by the presence of copper in the present alloy is increasing the spread between forming and final temper strengths noted above. That is, copper can be present in this range without adversely affecting the high formability obtained before artificial aging; yet after forming and artificial aging, the presence of the copper operates to increase the strength level of the final product. For example, copper present in the controlled amounts indicated adds little to the strength of the forming temper, thus keeping press loads relatively low yet it increases the strength of a final aged product by as much as 6 ksi. It is important that the copper be controlled within these limits especially the upper limit since, in addition to the formability and strengths, copper in excess of this amount can be detrimental in the area of diminished weldability, an important aspect of the present invention which will also be discussed in more detail hereinafter.

Iron contributes to grain size control and formability and is present between a minimum of 0.05%, preferably 0.1% minimum, and a maximum of 0.35%, preferably 0.3% maximum. Iron present in these amounts enhances formability whereas higher or lower amounts detract from formability as by causing orange peel or cracking during forming.

The amount of manganese present in the alloy is preferably in the range of 0.25 to 0.40%. Manganese is added to contribute to grain size control, which aids formability. Manganese is a preferred grain refining material since its effects are often relatively insensitive to quenching rates and thus it is believed that slower and cheaper quench media such as air can be used. Chromium and zirconium can be used but on a less preferred basis. The amount of chromium which can be used ranges from about 0.1 to 0.3% and the amount of zirconium, 0.05 to 0.15%. The use of chromium can lead to problems by causing distortion or lowering strength properties if the quenching rates are not carefully controlled. Excessive distortion of sheet such as buckling can require large amounts of stretching to provide flatness. Excessive stretching operates to lower the level of formability and is thus preferably avoided.

With respect to grain size mentioned, sheet products in accordance with the invention preferably have a grain size of at least 15,000 grains/mm$^3$ or finer by which is meant that the maximum grain size corresponds to this figure, with still further grains corresponding to a larger number per cubic millimeter. For inner panel 20, preferably the grain size is at least 20,000 grains/mm$^3$ or finer and for outer panel 10, preferably at least 30,000 grains/mm$^3$ or finer.

As well as providing the alloy with controlled amounts of alloying elements as described hereinabove, it is preferred that the alloy be prepared according to specific method steps in order to provide the most desirable characteristics. Thus, the alloy described herein can be provided as an ingot or billet for fabrication into a suitable wrought product by techniques currently employed in the art, with continuous casting being preferred. The cast ingot may be preliminarily worked or shaped to provide suitable stock for subsequent working operations. Prior to the principal working operations, the alloy stock is preferably subjected to homogenization, and preferably at metal temperatures in the range of 900° to 1100° F for a time period of at least one hour in order to dissolve magnesium and silicon or other soluble elements, and homogenize the internal structure of the metal. A preferred time period is 2 hours or more in the homogenization temperature range. Normally, the heat up and homogenizing treatment does not have to extend for more than 24 hours; however, longer times are not normally detrimental. A time of 3 to 12 hours at the homogenization temperature has been found to be quite suitable. In addition to dissolving constituent to promote workability or formability, this homogenization treatment is important in that it is believed to coalesce any undissolved constituents such as those formed by iron, manganese and silicon which coalescence also aids in providing the present alloy with superior formability characteristics.

After the homogenizing treatment, the metal can be rolled or extruded or otherwise subjected to working operations to produce stock such as sheet or extrusions or other stock suitable for shaping into the end product. To produce a sheet-type product, a body of the alloy is preferably hot rolled to a thickness ranging from about 0.100 to about 0.16 or 0.2 inch, typically around 0.144 inch. For hot rolling purposes, the temperature should be in the range of 1050° down to 400° F. Preferably, the metal temperature initially is in the range of 800° to 1050° F and the temperature at the completion is preferably 400° to 600° F.

When the intended use of a sheet product is for bumper or bumper back-up bar applications, normally operations other than hot rolling or unnecessary for this rather thick sheet of, typically, 0.100 to 0.250 inch. Where the intended use is body panels requiring a thinner gauge, further reduction as by cold rolling can be provided. Such reductions can be to body sheet thicknesses ranging, for example, from 0.019 to 0.077 inch, usually from 0.032 to 0.050 inch.

After rolling a body of the alloy to the desired thickness, the sheet is subjected to a solution heat treatment to substantially dissolve soluble elements. The solution heat treatment is preferably accomplished at a temperature in the range of 900° to 1100° F and normally produces a recrystallized grain structure. With respect to solution heat treating stock of herein described alloy type I having the preferred composition for outer panels, 0.9 to 1.1% silicon and 0.7 to 0.9% magnesium, it is preferred to use a solution heat treating temperature in the range of 1000° to 1070° F as such facilitates achieving very good combinations of strength and formability. With respect to the preferred composition for inner support panels, alloy type II, containing 0.7 to 0.9% silicon and 0.4 to 0.6% magnesium, the preferred solution heat treating temperature is in the range of 915° to 990° F, although higher temperatures are not necessarily detrimental.

Solution heat treatment can be performed in batches or continuously and the time for treatment can vary from hours for batch operations down to as little as a few seconds for continuous operations. Basically, solution effects can occur fairly rapidly, for instance in as little as one to ten seconds, once the metal has reached a solution temperature of about 1000° or 1050° F. However, heating the metal to that temperature can involve substantial amounts of time depending on the type of operation involved. In batch treating a sheet product in a production plant, the sheet is treated in a furnace load and an amount of time can be required to bring the entire load to solution temperature and accordingly solution heat treating can consume one or more hours, for instance one or two hours or more in batch solution treating. In continuous treating, the sheet is passed continuously as a single web through an elongated furnace which greatly increases the heat-up rate. The continuous approach is favored in practicing the invention, especially for sheet products, since a relatively rapid heat-up and short dwell time at solution temperature tend to favor a finer grain size. Accordingly, the inventors contemplate solution heat treating in as little as about 10 minutes, or less, for instance about 1 to 5 minutes, with times as short as a few seconds, for instance 5 or 10 seconds, being feasible. As a further aid to achieving a short heat-up time, a furnace temperature or a furnace zone temperature, significantly above the desired metal temperature provides a greater temperature head useful to speed heat-up times.

To further provide for the desired strength and formability necessary to the final product and to the operations in forming that product, the sheet should be rapidly quenched to prevent or minimize uncontrolled precipitation of $Mg_2Si$. Thus,it is preferred in the practice of the present invention that the quenching rate be at least 10° F/sec. from solution temperature to a temperature of about 350° F or lower. A preferred quenching rate is at least 300° F/sec. in the temperature range of 750° F or more to 550° F or less. After the metal has reached a temperature of about 350° F, it may then be air cooled.

Prior to forming sheet into wrought products such as panels, it is preferred to subject it to a stretching treatment to improve its flatness. However, it should be noted that such stretching is preferably carefully controlled so as not to exceed 3% and preferably not to exceed 1.5% increase in length. An excess stretching treatment can act to lower the level of formability, as noted earlier. By conforming to these controls, the sheet product can be easily formed into intricate parts on a highly consistent basis without cracking or exhibiting roughness such as orange peel both of which are obviously considered unacceptable, especially on outer panels, and which can lead to undesirable repair time in the automobile assembly line.

Typically, an extruded beam section can be used for bumper applications as well as a hot rolled sheet product as mentioned above. The extruded cross section approximates the section of the bumper with the only forming remaining typically being a relatively simple shaping or bending to an arc commensurate with the configuration across the front or rear of a vehicle. The alloy, preferably homogenized, is extruded into a beam or structural section typically of generally channel-like configuration as shown in FIG. 4, at a temperature in the range of 700° to 1000° F. If the extrusion operation is carried out at a sufficiently high temperature, for instance 900° or 1000° or more, the extrusion could be quenched as it exits the extrusion die thus eliminating separate solution heat treatment and quenching operations. However, it is usually preferable to separately solution treat the extrusion to favor the best properties. This is especially the case where the extrusion is fashioned from the alloy type I composition corresponding to that herein preferred for outer panels, which composition favors strength and dent resistance but can be more sensitive to precise solution temperature control.

The improved sheet and other wrought products produced as herein described have a range of yield strength of from around 10 or 12 ksi to around 35 ksi, typically 12 to 32 ksi, for sheet in the naturally aged condition following proper solution and quench treatments as described herein. The higher strength levels would correspond to higher amounts of alloying elements, particularly Si and Mg. The naturally aged condition is achieved without any added treatment and occurs naturally with the passage of time. There are two aspects of natural aging in the improved practice which make such particularly suited to use in automotive or vehicular body applications. One aspect is that a stable property level is reached relatively quickly, after about only 1 or 2 weeks, or perhaps a month at room temperature, wherein the strength levels off and remains substantially at or near a relatively constant level for many months, or even years. Another aspect is that this stable level of properties is characterized by strength and formability qualities particularly suited to automotive or vehicular body applications. The condition of naturally aged stable properties is termed the T4 temper.

Aluminum wrought products produced in accordance with the foregoing practice provide material having the strength and forming characteristics required to serve as automotive or vehicular body sheet. These forming characteristics for this purpose are inconvenient to define or quantify directly. They do, however, correlate with certain standard tests such as the Olsen cupping test, tensil tests and bend tests. The Olsen cupping test is indicative of a metal's ability to be drawn into a cup-like shape. The deeper (or taller) the cup which can be drawn without the metal breaking, the more formable the metal. The bend test also relates to formability, especially with respect to the hemming or seaming which is sometimes employed to join inner and outer panels in a dual panel structure such as a door or hood. The type of seaming or hemming referred to is illustrated in FIG. 2. It will be observed that bend 30 of hem 32 can be 180° bend and the radius of curvature can be equivalent to half the thickness (½ T) of the metal. For example, the bend radius would be 0.02 inch for 0.04 inch thick sheet. Automotive body sheet should be capable of withstanding such 180°–½ T bends without cracking, crazing or other signs of failure or incipient failure. The cracking in the hemming operation not only weakens the structure comprising the outer panel and support panel, but is also generally considered unacceptable aesthetically and can necessitate additional work to fill in and finish the hem area.

Figure 5:
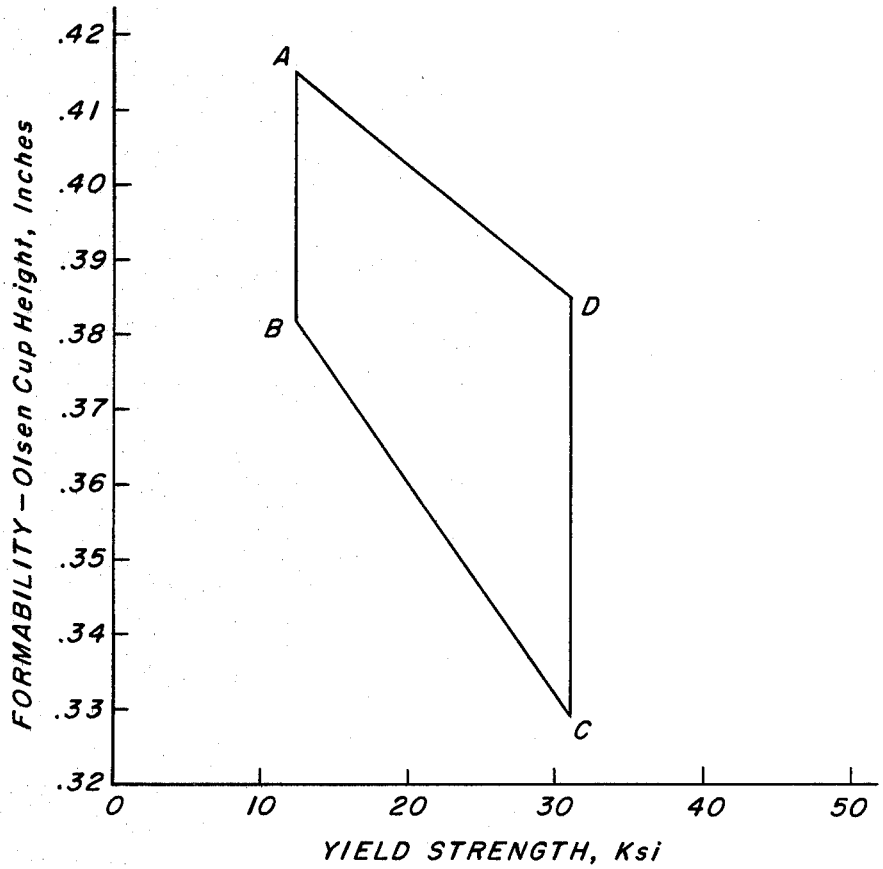
FIG. 5 is a graph showing forming characteristics of the alloy product as related to its yield strength.

FIG. 5 shows a plot of Olsen cupping height versus transverse yield strength for sheet in the solution heat treated, quenched and naturally aged (to a stable property level) condition, referred to as the T4 temper. As discussed elsewhere herein, a stable property level for the improved aluminum products is achieved after about 2 weeks to 1 month of natural aging. Olsen cup values referred to herein are measured according to procedures outlined in a publication entitled "Comparison of Olsen Cup Values on Aluminum Alloys", first edition published by the Aluminum Association, February 1975. The lubricant used in measurements is a combination of Quaker Draw 289 oil and lab #4 polyethylene.

According to one aspect of the present invention, formability as related to the yield strength of the alloy should preferably fall within the perimeter of the area defined by the points ABCD of FIG. 5. It will be appreciated from an inspection of FIG. 5 that minimum Olsen cup values can vary depending on the yield strength.

With respect to the minimum yield strength and formability relationship denoted by the line BC, there are important preferred ranges of yield strength and levels of formability. Thus, for purposes of fabricating inner support panel 20, as depicted in FIG. 1, it is preferred to choose a level of formability not lower than that corresponding to a transverse yield strength, before aging, in the range of 14 to 22 ksi. Such level of formability is obtained by working within the preferred composition ranges of silicon and magnesium noted hereinabove. That is, as noted earlier, with respect to the composition of alloy type II for purposes of fabricating the inner support panel, silicon should be in the range of 0.7 to 0.9% and magnesium in the range of 0.4 to 0.6%. The level of low yield strength and high formability obtained by observing these limitations permits the fabrication of a rather intricately shaped member whose benefits are derived from the stiffening effect or rigidity provided by virtue of its design. With respect to the outer panel member 10, such as a hood, door, or even bumper member, the intended use requires high resistance to dents and high strength, especially in the case of the bumper. Thus, for purposes of fabricating such outer panels, including bumper members, it is preferred to choose at least a level of formability corresponding to a transverse yield strength, before aging, in the range of 23 to 30 ksi which strength level is achieved by working within the preferred ranges of alloy type I, specifically 0.9 to 1.1% silicon and 0.7 to 0.9% magnesium. Thus, it can be seen that by careful controls, high levels of strength and formability can be obtained and that these can be selectively utilized to special application within the overall practice of the invention.

Sheet or other wrought products produced in accordance herewith are relatively readily formed into shaped or contoured automotive panels or structural members. Such forming typically includes pressing or stamping between opposite mating dies. In the case of a bumper, an extrusion or relatively thick sheet is stamped to provide the longitudinal curvature. A wheel is formed by first forming a welded hoop from a sheet, further forming the hoop to provide the desired contour and the welding or riveting to the inside of the hoop of the radial spider member which is typically stamped from sheet. These forming operations are typically carried out at room temperature but can be effected at slightly elevated temperatures of up to around 200° or at the so-called warm forming temperatures of up to around 400° F or perhaps 450° F. However, it is preferred in some instances to perform the forming at substantially room temperature meaning not over 150° or 200° F in order to avoid inducing uncontrolled precipitation effects in the alloy member.

After forming the wrought aluminum sheet or other product into the automotive panel, the panel can be artificially aged. This can be accomplished by subjecting the shaped product to a temperature in the range of 225° to 500° F for a sufficient period of time to provide the desired yield strength. That is, the shaped panel is capable of being artificially aged to a yield strength of at least 30 ksi. The period of time can run from 2 minutes to 100 hours. Preferably, artificial aging is accomplished by subjecting the formed product to a temperature in the range of 350° to 425° F for a period of at least 25 minutes. A suitable practice contemplates as aging treatment of 25 minutes at a temperature of 375° to 400° F. The strength of the shaped panel members after artificial aging, referred to as the T6 temper, ranges from around 30 to about 55 ksi or more, depending on alloy content, which is about 10 or 15 to 20 or more ksi higher than the T4 level for a given composition.

An advantage of the present invention resides in the aging characteristics of the alloy products. For example, certain aluminum alloys are strain hardened, e.g. 5182, and in their application on an automobile are often subjected to temperatures in the range of 250° to 400° F for curing or baking in the paint cycle, which temperature acts to provide an annealing effect, which can lower the strength of the metal. By comparison, the present alloy's strength is increased by such paint bake cycle which can be used instead of the artificial aging step referred to earlier, thus providing an economical advantage in addition to the strength advantage.

In addition, the present alloy is advantageous in the joining or fastening aspect as by resistance welding, for example, of an inner support panel to an outer panel; the welding electrode life in such operation is extended up to at least 50 to 100 percent over certain other alloys such as 2036 and 5182. Electrode life is an important factor, especially in the production line. Short electrode life results in a high frequency of interruptions for electrode repair of replacement purposes, which can seriously interfere with production schedules.

The present alloy is advantageous in another way. Because of the emphasis put on conserving energy resources, means other than welding for joining metals such as outer and inner panels has been given attention. Seaming or hemming the outer panel to the inner panel has received widespread use. However, to be adapted to such technique, the outer panel should have a sufficiently high level of bendability or formability to sustain the hemming which level is often lacking in certain aluminum alloy sheet products otherwise meeting the desired strength requirements. Some such alloys, while sustaining the seaming operation without cracking, can exhibit the orange peel effect referred to earlier, which is aesthetically undesirable. The present alloy in sheet form meets the requirements for seaming and has a bendability as measured by radius of curvature as low as ½ the thickness of the sheet in a 180° bend without exhibiting unacceptable roughening or orange peel effect. Thus, designs do not have to be compromised to work around this effect.

Still further accelerated studies have shown that bumpers fabricated in accordance with the present invention are relatively insensitive to stress corrosion cracking and exfoliation type corrosion. Furthermore, such bumpers lend themselves to chrome plating without difficulty or introducing further problems. These added benefits still further commend the improvement to widespread automotive applications.

The following examples are still further illustrative of the invention.

EXAMPLE 1

An aluminum alloy, referred to as alloy A, having its composition in accordance with alloy type II of the invention and consisting of, by weight, 0.75% Si, 0.33% Mn, 0.53% Mg, 0.22% Fe, 0.30% Cu, 0.02% Ti, the balance essentially aluminum, was cast into ingot suitable for rolling. The ingot was homogenized in a furnace at a temperature of 1050° F for 7 hours and then hot rolled into a sheet product about 0.144 inch thick which was cold rolled to a sheet thickness of 0.040 inch. This sheet was solution heat treated in a continuous heat treating furnace at a temperature of 1060° F for a furnace time in the neighborhood of about 2-½ minutes and then quenched with cold water spray to room temperature. Properties including transverse yield strength, formability and bendability of the sheet in the aforesaid condition followed by natural aging to a stable property level, referred to as T4 temper, are set forth in Table I. For purposes of artificially aging, some of the sheet was treated for 8 hours at a temperature of 350° F to increase its strength. The properties of the sheet in this condition, referred to as a T6 temper, are also listed in Table I. These properties are compared to properties typically representative of sheet of like thickness in alloys 2036, 5182 and 6151 which had a composition as noted earlier. For 5182 the temper is designated "0" meaning fully annealed. Bendability was determined by bending the sheet about 180° turn having a radius of ½ T, i.e., ½ the thickness of the sheet. The Olsen cup test was as described above.

The yield strength values for sheet products referred to herein are typically based on specimens taken in the transverse direction, the direction across the sheet and normal to the direction of rolling. These values are sometimes less than those for the longitudinal specimens since the latter can be higher because of stretching which is effected in the longitudinal direction and increase the longitudinal strength values more than the transverse values. Extrusions are normally measured for strength in the longitudinal direction and their strength levels for a given composition tend to be higher than those of sheet.

Table I

| Sheet | Temper | Yield Strength | Formability (Olsen Cup Height) | Bendability at 0.5T (180°) |
|---|---|---|---|---|
| A | T4 | 21.0 ksi | 0.374" | No orange peel or cracking |
| A | T6 | 45.8 ksi | — | — |
| 2036 | T4 | 30.0 ksi | 0.354" | Severe cracking |
| 2036 | T6* | 40.0 ksi* | — | — |
| 5182 | 0 | 19.0 ksi | 0.390" | No orange peel or cracking |
| 6151 | T4 | 21.0 ksi | 0.345" | Severe cracking |
| 6151 | T6 | 45.0 | — | — |

Table I-continued

| Sheet | Temper | Yield Strength | Formability (Olsen Cup Height) | Bendability at 0.5T (180°) |
|---|---|---|---|---|
| | | ksi | | |

*Alloy 2036 is not normally treated to a true T6 condition and the above value for "T6" is based on one hour at 400° F.

From this example it can be seen that sheet A, in accordance with the invention, provides a high degree of formability as measured by Olsen cup height and the ability to sustain the ½ T-180° bend test without exhibiting orange peel or cracking.

Alloy 2036 while possessed of a reasonable cupping value (considering its yield strength) falls short on bendability. Alloy 6151 falls short on both cupping and bending. Alloy 5182 appears satisfactory from the workability standpoint but, as indicated earlier, its strength limits its usefulness.

EXAMPLE 2

An aluminum alloy, referred to as alloy B, having its composition in accordance with alloy type I of the invention and consisting of, by weight, 0.98% Si, 0.22% Fe, 0.34% Cu, 0.32% Mn, 0.80% Mg, 0.02% Ti, the balance essentially aluminum, was cast into ingot suitable for rolling. The ingot was fabricated into 0.040 inch thick sheet and thermally treated as in Example 1. The properties of alloy B sheet are listed in Table II.

Table II

| Temper | Yield Strength (Transverse) | Formability (Olsen Cup Height) | Bendability at 0.5T (180°) |
|---|---|---|---|
| T4 | 26 ksi | 0.358" | No cracking |
| T6 | 51.2 ksi | — | — |

Sheet B is a higher strength version of the improvement especially suited to outer panels and, it should be noted, continues to demonstrate still more significant improvement with respect to T6 strength over alloy 2036, than did sheet A in Example 1.

EXAMPLE 3

A simulated hood panel of reduced size relative to a domestic sedan and measuring about 30 inches long by about 24 inches wide was fabricated from alloys A and B produced in Examples 1 and 2. The dual panel structure was in general accordance with that shown in FIGS. 1 and 2. In this instance, both inner and outer panels were stamped from each of alloys A and B to further verify the desired workability of both alloy compositions. The structures were completely free of any cracks or orange peel defects and also free from lueders' lines.

Full size automotive hood inner and outer panels were stamped from sheet products in alloy types I and II in accordance with the invention and produced in the general manner according to Example 1. The sheet thickness was a nominal of about 0.04 inch. The sheet of alloy type I had a transverse yield strength of about 23 to 26 ksi and the alloy type II sheet had a yield strength of about 19 to 20 ksi. Alloy type I sheet was stamped into outer panels and both alloy types I and II sheets were stamped into inner panels. The forming operations were successful in that the improved sheet formed as well as, or better than, the 5182 and 2036 alloys which were used previously for the inner and outer panels, respectively, in this hood structure.

EXAMPLE 4

Sheet of alloys A and B of Examples 1 and 2 having a thickness of 0.04 inch were electrically spot welded for purposes of illustrating the electrode life expectance in production operations. For purposes of comparison, aluminum alloys 5182 and 2036 were also welded in the same manner. The data is tabulated below in Table III.

Table III

| Alloys Welded | Average Number of Welding Spots Per Electrode | Range of Welding Spots Per Electrode |
|---|---|---|
| A welded to A | 1600 | 1500–1800 |
| B welded to B | 1600 | 1500–1800 |
| 5182 welded to 5182 | 800 | 700–1000 |
| 2036 welded to 2036 | 800 | 700–1000 |

EXAMPLE 5

Sheet of Alloy B of Example 2 was welded by gas metal-arc welding, referred to as MIG welding, for purposes of illustrating the integrity of such welds. The alloy was welded and tested as tabulated below in Table IV.

Table IV

| Temper | Tensile Strength ksi |
|---|---|
| T4 sheet without weld | 44.0 |
| T4 sheet welded to T4 sheet | 37.9 |
| T4 sheet welded to T4 sheet and artificially aged to T6 | 46.5 |
| T6 sheet without weld | 56.4 |
| T6 sheet welded to T6 sheet | 38.0 |
| T6 sheet welded to T6 sheet and subjected to an artificial aging treatment of 8 hours at 350° F | 46.2 |

It is seen that after welding, the strength of the weld can be increased significantly by subjecting the welded part to an artificial aging treatment.

EXAMPLE 6

Specimens of sheets of alloys A and B of Examples 1 and 2 in the T4 and T6 tempers were tested for corrosion properties in accelerated tests. The specimens were found to be highly resistant to 3-½% and 5% NaCl continuous and intermitten sprays. Also, it was found that specimens tested for one month by alternate immersion in a 3% NaCl solution showed no visible corrosive attack.

EXAMPLE 7

Specimens of sheets A and B of Examples 1 and 2 in the T4 temper, that is, prior to the artificial aging treatment, were subjected to a temperature of 385° F for 15 minutes and a temperature of 420° F for 10 minutes. These times and temperatures are representative of those used for paint baking or curing. Transverse tensile properties before (T4 temper) and after the paint baking cycle, which approximates artificial aging to the T6 temper, are listed below in Table V.

Table V

| Alloy and Temper | Tensile Strength ksi | Yield Strength ksi |
|---|---|---|
| A T4 | 34.8 | 21.0 |
| A paint cycle | 44.9 | 40.8 |
| B T4 | 42.1 | 25.9 |
| B paint cycle | 51.0 | 47.0 |

It can be seen that a typical paint baking or curing treatment significantly increases the tensile properties. Thus, the paint baking cycle can be substantially substituted for the artificial aging step, if desired.

EXAMPLE 8

Bumper members produced from sheet of alloy B of Example 2 were chrome plated electrolytically employing a commercial type chrome plating bath. The chrome plated finish exhibited a high level of brilliance and was found to have excellent adhesion to the base metal and compare satisfactorily with chrome plated steel. The chrome plated members were tested for resistance to corrosion by first scoring the chrome plated finish and thereafter exposing them for 44 hours in a copper-accelerated acetic acid-salt spray, referred to as the CASS test, having ASTM Designation B-368-68. Examination of the score or scribe marks after exposure indicated no undermining or blistering of the chrome plating which is indicative of good plating adhesion.

EXAMPLE 9

An aluminum alloy having a composition essentially similar to those of sheet B in Example 2, except that Fe was 0.47%, was fabricated into sheet as described in Example 1. Specimens of this sheet were found to have a yield strength in the T4 condition of 26.7 ksi and formability, as measured by Olsen cup technique, was found to be 0.334 inches. The bendability test showed the metal to be subject to severe cracking. The diminished Olsen cup values and the bend height figure is considered significant and is believed to result from the higher iron content.

EXAMPLE 10

An aluminum alloy consisting of 1.13% Si, 0.18% Fe, 0.47% Cu, 0.43% Mn, 0.78% Mg, 0.02% Ti, the remainder essentially aluminum, was cast into ingot suitable for rolling. The ingot was homogenized by subjecting it to a temperature of 1050° F for 7 hours. Starting at a temperature of 950° F, the ingot was rolled into a sheet product 0.15 inch thick. The sheet was solution heat treated at 1060° F for 30 minutes and then quenched in cold water. Specimens from the sheet were allowed to naturally age and other specimens were artificially aged. The transverse properties resulting from the aging treatments are tabulated below in Table VI.

Table VI

| Naturally Aged Material (T4) | | | |
|---|---|---|---|
| Aging Time | Tensile Strength | Yield Strength | % Elongation |
| 1 day (approx.) | 39.9 ksi | 17.6 ksi | 31.0% |
| 1 week | 47.3 ksi | 26.6 ksi | 29.5% |
| 2 weeks | 48.6 ksi | 27.2 ksi | 29.5% |
| 4 weeks | 49.2 ksi | 28.5 ksi | 29.5% |
| 3 months | 49.5 ksi | 28.7 ksi | 31.0% |

| Artificially Aged Material (T6) | | | |
|---|---|---|---|
| Aging Time | Tensile Strength | Yield Strength | % Elongation |
| 1 hr./400° F | 57.0 ksi | 53.6 ksi | 12.0% |

Table VI-continued

| | | | |
|---|---|---|---|
| 8 hrs./350° F | 58.8 ksi | 54.8 ksi | 13.0% |

Thus, it will be seen that the alloy has the capability to increase its strengths significantly by naturally and artificially aging. Moreover, the properties are more or less stable after only a week of naturally aging. The artificially aged or T6 condition is preferable from the standpoint of maximum strength but the naturally aged T4 condition can also be useful for certain applications and is a preferred temper for forming operations.

While the invention has been described in terms of preferred embodiments, the claims appended hereto are intended to encompass other embodiments of the invention.

Having thus described the invention and certain embodiments thereof, we claim:

1. A method of producing a vehicular structural member, comprising the steps of:

(a) providing a body of aluminum base alloy consisting essentially of 0.4 to 1.2% Si, 0.4 to 1.1% Mg, 0.05 to 0.35% Fe, 0.1 to 0.6% Cu, and at least one element from the group consisting of 0.2 to 0.8% Mn, 0.1 to 0.3% Cr and 0.05 to 0.15% Zr, the balance essentially aluminum and incidental elements and impurities;

(b) working said body to produce a wrought aluminum product;

(c) solution heat treating said wrought aluminum product at a temperature within the range of 900° to 1100° F;

(d) quenching said product;

(e) aging said product to a condition having a substantially stable level of mechanical properties to provide a solution heat treated, quenched and aged product that is readily formable and has a yield strength of 12 to 35 ksi; and (f) forming said aged product in said condition into said structural member.

2. The method according to claim 1 wherein said alloy contains 0.2 to 0.8% Mn.

3. The method according to claim 1 wherein said product in said condition has a minimum Olsen cupping value as related to its yield strength in accordance with line BC of FIG. 5.

4. The method according to claim 1 wherein said alloy contains 0.9 to 1.1% Si, 0.7 to 0.9% Mg and 0.2 to 0.8% Mn and said yield strength ranges from 23 to 30 ksi.

5. The method according to claim 1 wherein said alloy contains 0.7 to 0.9% Si, 0.4 to 0.6% Mg and 0.2 to 0.8% Mn and said yield strength ranges from 14 to 23 ksi.

6. The method according to claim 1 wherein said working includes cold rolling to a sheet product 0.019 to 0.077 inch thick.

7. The method according to claim 1 wherein said product in said step (e) is naturally aged to a T4 condition and is formed in said T4 condition into said structural member which is heated to a temperature of 225° to 500° F, thereby increasing the strength thereof.

8. The method according to claim 1 wherein said solution heat treating is effected within a time of 10 minutes.

9. The method according to claim 1 wherein said alloy contains 0.7 to 1.1% Si, 0.4 to 0.9% Mg and 0.2 to 0.8% Mn.

10. A method of producing a vehicular structural member comprising the steps of:

(a) providing a body of aluminum base alloy consisting essentially of 0.4 to 1.2% Si, 0.4 to 1.1% Mg, 0.05 to 0.35% Fe, 0.1 to 0.6% Cu, 0.2 to 0.8% Mn, the balance essentially aluminum and incidental elements and impurities;

(b) working said body to produce a wrought product;

(c) solution heat treating said wrought product at a temperature within the range of 900° to 1100° F;

(d) quenching said product;

(e) aging said product into the T4 condition to provide a solution heat treated, quenched and aged product that is readily formable and has a yield strength of 12 to 35 ksi;

(f) forming said aged product into a structural member; and (g) heating said structural member to a temperature of 225° to 500° F, thereby increasing the strength thereof.

11. The method according to claim 10, wherein said working includes rolling to a sheet product.

12. The method according to claim 10, wherein said working includes cold rolling to a sheet product 0.019 to 0.077 inch thick.

13. The method according to claim 12, wherein said cold rolled sheet has a fine grain size such that there is an average of at least 15,000 grains per cubic millimeter.

14. The method according to claim 10, wherein said alloy contains 0.9 to 1.1% Si and 0.7 to 0.9% Mg, and the yield strength of the aged T4 product in said step (e) of said claim 1 ranges from 23 to 30 ksi.

15. The method according to claim 10, wherein said alloy contains 0.7 to 0.9% Si and 0.4 to 0.6% Mg, and the yield strength of said aged T4 product ranges from 14 to 23 ksi.

16. The method according to claim 10, wherein said structural member has a heat curable coating thereon, and the heating in said step (g) of said claim 1 cures the coating as well as strengthens the structural member.

17. The method according to claim 10, wherein said working in said step (b) includes extruding.

18. The method according to claim 10, wherein said vehicular structural member is a bumper and said working in said step (b) includes extruding to produce an extruded wrought product which is formed along its length to provide said bumper.

19. The method according to claim 10, wherein said vehicular structural member is a bumper and said working in said step (b) includes rolling to produce a rolled sheet product which is formed by operations including stamping to provide said bumper.

20. The method according to claim 18, wherein said aluminum alloy contains 0.9 to 1.1% Si and 0.7 to 0.9% Mg.

21. The method according to claim 1, wherein said vehicular structural member is a wheel and said working in said step (b) includes rolling to produce a rolled sheet product of said alloy which is shaped into at least a portion of said wheel.

22. The method according to claim 11, wherein said product in said condition has a minimum Olsen cupping value as related to its yield strength in accordance with line BC of FIG. 5.

23. The method according to claim 10, wherein said Si is present in 0.2 to 0.5% excess over the stoichiometric equivalent of Mg based on th compound $Mg_2Si$.

24. The method according to claim 10, wherein said solution heat treating is effected in a time of 10 minutes or less.

25. The method according to claim 10, wherein said solution heat treating is effected in 1 to 5 minutes.

26. A method of producing a plural panel vehicular structural member having spaced generally parallel inner and outer panels connected along peripheral portions thereof comprising the steps of:

(a) providing a body of aluminum base alloy consisting essentially of 0.4 to 1.2% Si, 0.4 to 1.1% Mg, 0.05 to 0.35% Fe, 0.1 to 0.6% Cu, 0.2 to 0.8% Mn, the balance essentially aluminum and incidental elements and impurities;
(b) homogenizing said body at a temperature in the range of 900° to 1100° F;
(c) hot rolling said body to produce a hot rolled sheet;
(d) cold rolling said hot rolled sheet to provide a cold rolled sheet ranging in thickness between 0.019 and 0.077 inch;
(e) solution heat treating said cold rolled sheet at a temperature within the range of 900° to 1100° F;
(f) quenching said sheet at a rate of at least 10° F per second to a temperature of 350° F or below;
(g) aging said sheet product into the T4 condition to provide a solution heat treated, quenched and aged sheet product that is readily formable and has a yield strength of 12 to 31 ksi;
(h) forming a portion of such aged sheet product substantially at room temperature into an outer panel member by operations including stamping;
(i) forming a further portion of such aged sheet product substantially at room temperature into an inner panel by operations including stamping to produce a panel having raised and recessed portions imparting flexural stiffness thereto;
(j) connecting said inner and outer panels together at peripheral portions thereof to provide a plural panel vehicular structural member;
(k) applying a heat curable coating to at least one surface portion of said automotive structure; and
(l) heating said vehicular structure to a temperature of 225° to 500° F to cure said coating and to increase the strength of said plural panel vehicular structure.

27. The method according to claim 26, wherein said sheet for said outer panel contains 0.9 to 1.1% Si and 0.7 to 0.9% Mg and, when aged, has a yield strength of 23 to 30 ksi.

28. The method according to claim 26, wherein said sheet for said inner panel contains 0.7 to 0.9% Si and 0.4 to 0.6% Mg and, when aged, has a yield strength of 14 to 23 ksi.

29. The method according to claim 26, wherein said sheet for said outer panel contains 0.9 to 1.1% Si and 0.7 to 0.9% Mg and, when aged, has a yield strength of 23 to 30 ksi, and wherein said sheet for said inner panel contains 0.7 to 0.9% Si and 0.4 to 0.6% Mg and, when aged, has a yield strength of 14 to 23 ksi.

30. The method according to claim 26, wherein in said step (j) said panels are connected by hemming the same together.

31. The method according to claim 26, wherein in said step (j) said panels are connected by spot welding the same together.

32. In the method of producing a vehicular structural member wherein an aluminum alloy product is formed to produce said member, the improvement wherein said product is provided as an alloy consisting essentially of, by weight, 0.4 to 1.2% Si, 0.4 to 1.1% Mg, 0.05 to 0.35% Fe, 0.1 to 0.6% Cu, 0.2 to 0.8% Mn, the balance essentially aluminum and incidental elements and impurities, said product further being provided in the condition resulting from:

(a) working a body of said alloy to provide a wrought product;
(b) solution heat treating said wrought product at a temperature in the range of 900° to 1100° F;
(c) quenching said product at a rate of at least 10° F/sec. to a temperature of 350° F or less; and
(d) aging said product to a condition having a substantially stable level of mechanical properties to provide a solution heat treated, quenched and aged product that is readily formable and has a yield strength of 12 to 35 ksi.

33. In the method according to claim 32, said working of said body including rolling into a sheet product.

34. In the method according to claim 32, said working of said body including rolling into a sheet product having a thickness in the range of 0.10 to 0.25 inch.

35. In the method according to claim 32, said working of said body including cold rolling into a sheet having a thickness in the range of 0.019 to 0.077 inch.

36. In the method according to claim 32, extruding said body into a wrought product having a beam section.

37. In the method according to claim 36, extruding said body at a temperature in the range of 700° to 1000° F.

38. In the method according to claim 32, providing an alloy which contains silicon in the range of 0.7 to 1.1% and magnesium in the range of 0.4 to 0.9%.

39. In the method according to claim 38, hot rolling said body followed by cold rolling into a sheet product.

40. In the method according to claim 32, providing said alloy with said iron in the range of 0.1 to 0.3% and said copper in the range of 0.25 to 0.50%.

41. In the method according to claim 32, cold rolling said body to a sheet of 0.019 to 0.077 inch thick and stretching the sheet up to 3% after said quenching step (c).

42. In the method according to claim 32, providing an alloy which contains not more than 0.2 wt.% zinc, 0.1 wt.% titanium and 0.05 wt.% other impurities.

43. In the method according to claim 35, producing a wrought product having at least a level of formability as related to its yield strength in accordance with line BC of FIG. 5.

44. In the method according to claim 32, prior to said working in said step (a), homogenizing a body of the alloy at a temperature of 900° to 1100° F.

45. In the method of producing a vehicular panel wherein an aluminum alloy product is formed to produce said panel, the improvement wherein said product is provided as an alloy consisting essentially of, by weight, 0.4 to 1.2% Si, 0.4 to 1.1% Mg, 0.05 to 0.35% Fe, 0.1 to 0.6% Cu, 0.2 to 0.8% Mn, the balance essentially aluminum and incidental elements and impurities, said product further being provided in the condition resulting from:

(a) homogenizing a body of said alloy at a temperature in the range of 900° to 1100° F;
(b) hot rolling said body to produce a hot rolled sheet having a thickness in the range of 0.10 to 0.25 inch;

(c) cold rolling said hot rolled sheet to provide a cold rolled sheet having a thickness in the range of 0.019 to 0.077 inch;

(d) solution heat treating said cold rolled sheet at a temperature in the range of 900° to 1100° F;

(e) quenching said sheet at a rate of at least 10° F/sec. to a temperature of 350° F or less; and (f) stretching said sheet up to 3% to improve the flatness thereof, said sheet, after natural aging to a T4 condition, being characterized by having a yield strength of 12 to 31 ksi, a fine grain size of 15,000 grains/mm$^3$ or finer, and at least a level of formability as related to its yield strength as defined by the line BC of FIG. 5.

46. In the method according to claim 45, providing said alloy containing 0.7 to 1.1% Si and 0.4 to 0.9% Mg.

47. In the method according to claim 45, solution heat treating said cold rolled sheet in a time period of not over 10 minutes.

48. In the method of producing a plural panel vehicular structure having inner and outer sheet panels connected together along peripheral portions thereof, said outer panel being formed from a metal sheet to provide a configuration representative of a portion of an automotive body, and said inner panel being formed from metal sheet to provide a plurality of raised channel-like portions serving to increase the flexural strength of said second panel, the improvement wherein said metal sheet for at least one of said inner and outer panels is provided as an aluminum base alloy sheet product, said alloy consisting essentially of 0.4 to 1.2% Si, 0.4 to 1.1% Mg, 0.5 to 0.35% Fe, 0.1 to 0.6% Cu, 0.2 to 0.8% Mn, the balance essentially aluminum and incidental impurities, said aluminum alloy sheet product being in the condition resulting from:

(a) homogenizing a body of said alloy at a temperature in the range of 900° to 1100° F;

(b) hot rolling said body into a sheet having a thickness in the range of 0.10 to 0.25 inch;

(c) cold rolling said sheet to a thickness in the range of 0.019 to 0.077 inch;

(d) solution heat treating said sheet at a temperature in the range of 900° to 1100° F; and (e) quenching said sheet at a rate of at least 10° F/sec. to a temperature of 350° F or less, said sheet, after natural aging in a T4 condition, being characterized by having a yield strength of from 12 to 31 ksi, a fine grain size of 15,000 grains/mm$^3$ or finer and at least a level of formability as related to yield strength as defined by the line BC of FIG. 5.

49. In the method according to claim 48, providing sheet for said outer panel which contains 0.9 to 1.1% Si and 0.7 to 0.9% Mg and, when aged, has a yield strength of 23 to 30 ksi.

50. In the method according to claim 48, providing sheet for said inner panel which contains 0.7 to 0.9% Si and 0.4 to 0.6% Mg and, when aged, has a yield strength of 14 to 23 ksi.

51. In the method according to claim 48, providing sheet for said outer panel which contains 0.9 to 1.1% Si and 0.7 to 0.9% Mg and, when aged, has a yield strength of 23 to 30 ksi, and wherein said sheet for said inner panel contains 0.7 to 0.9% Si and 0.4 to 0.6% Mg and, when aged, has a yield strength of 14 to 23 ksi.

52. In the method of producing a plural panel vehicular structure having inner and outer panels connected together along peripheral portions thereof, said outer panel being formed from an aluminum alloy sheet to provide a configuration representative of a portion of a vehicle body, and said inner panel being formed from an aluminum alloy sheet to provide a plurality of raised channel-like portions serving to increase the flexural strength of said second panel, and said structure having a coating curable by heating to a temperature of from 225° F to about 500° F, the improvement wherein said sheet for at least one of said inner and outer panels is provided as an aluminum base alloy sheet product, said alloy consisting essentially of 0.4 to 1.2% Si, 0.4 to 1.1% Mg, 0.5 to 0.35% Fe, 0.1 to 0.6% Cu, 0.2 to 0.8% Mn, the balance essentially aluminum and incidental impurities, said sheet product being in the condition resulting from:

(a) homogenizing said body at a temperature in the range of 900° to 1100° F;

(b) hot rolling said body into a sheet having a thickness in the range of 0.10 to 0.25 inch;

(c) cold rolling said sheet to a thickness in the range of 0.019 to 0.077 inch;

(d) solution heat treating said sheet at a temperature in the range of 900° to 1100° F; and (e) quenching said sheet at a rate of at least 10° F/sec. to a temperature of 350° F or less, said sheet, after natural aging to a T4 condition, being characterized by having a yield strength of from 12 to 31 ksi, a fine grain size of 15,000 grains/mm$^3$ or finer, and at least a level of formability as related to yield strength as defined by the line BC of FIG. 5, said sheet being further characterized, after heating to cure said coating and artificially age the sheet, by a yield strength of 10 ksi, or more, higher than that of said T4 condition.

53. In the method of producing a vehicular panel wherein a sheet is formed by operations including stamping to provide said panel, the improvement wherein said sheet is provided as a solution heat treated, quenched and naturally aged aluminum alloy sheet product composed of an aluminum alloy consisting essentially of 0.7 to 1.1% Si, 0.4 to 0.9% Mg, 0.1 to 0.3% Fe, 0.1 to 0.6% Cu, 0.2 to 0.8% Mn, the balance essentially aluminum and incidental impurities, said first sheet being characterized by having a yield strength in the range of 14 to 31 ksi and at least a level of formability as related to its yield strength as defined by the line BC of FIG. 5, and being further characterized by having a grain size of at least 15,000 grains/mm$^3$ or finer.

54. In the method of producing a plural panel vehicular structure having inner and outer panels, said outer panel being formed from a first sheet to provide a configuration representative of a portion of a vehicle body, and said inner panel being formed from a second sheet to provide a plurality of raised channel-like portions serving to increase the flexural strength of said second panel, said inner and outer panels being connected along peripheral portions, the improvement which comprises:

(a) providing said first sheet as a solution heat treated, quenched and naturally aged aluminum alloy sheet product composed of an aluminum alloy consisting essentially of 0.9 to 1.1% Si, 0.7 to 0.9% Mg, 0.1 to 0.3% Fe, 0.1 to 0.6% Cu, 0.2 to 0.8% Mn, the balance essentially aluminum and incidental impurities, said first sheet being characterized by having a yield strength in the range of 23 to 30 ksi and at least a level of formability as related to its yield strength as defined by the line BC of FIG. 5, and being further characterized by having a grain size of at least 30,000 grains/mm$^3$ or finer; and (b) providing said second sheet as a solution heat treated, quenched and naturally aged aluminum alloy sheet product composed of an alloy consisting essentially of 0.7 to 0.9% Si, 0.4 to 0.6% Mg, 0.1 to 0.3% Fe, 0.1 to 0.6% Cu, 0.2 to 0.8% Mn, the balance essentially aluminum and incidental impurities, said second sheet being characterized by having a yield strength in the range of 14 to 22 ksi and at least a level of formability as related to its yield strength as defined by the line BC of FIG. 5, and being further characterized by having a grain size of at least 20,000 grains/mm$^3$ or finer.

* * * * *